US010964158B2

(12) United States Patent
Mohrhardt et al.

(10) Patent No.: US 10,964,158 B2
(45) Date of Patent: Mar. 30, 2021

(54) APPARATUS FOR RETROFIT OF AUXILIARY SERIAL COMMUNICATION PORT(S) IN A SLOT ACCOUNTING SYSTEM

(71) Applicant: JCM American Corporation, Las Vegas, NV (US)

(72) Inventors: Dominic Mohrhardt, Las Vegas, NV (US); Dave Kubajak, Las Vegas, NV (US)

(73) Assignee: JCM American Corporation, Las Vegas, NV (US)

( * ) Notice: Subject to any disclaimer, the term of this patent is extended or adjusted under 35 U.S.C. 154(b) by 86 days.

(21) Appl. No.: 16/560,841

(22) Filed: Sep. 4, 2019

(65) Prior Publication Data

US 2020/0111302 A1 Apr. 9, 2020

Related U.S. Application Data

(60) Provisional application No. 62/742,058, filed on Oct. 5, 2018.

(51) Int. Cl.
*G07F 17/32* (2006.01)
*G07F 17/34* (2006.01)

(52) U.S. Cl.
CPC ..... *G07F 17/3223* (2013.01); *G07F 17/34* (2013.01)

(58) Field of Classification Search
CPC ..... G07F 17/32; G07F 17/34
See application file for complete search history.

(56) References Cited

U.S. PATENT DOCUMENTS

| | | | |
|---|---|---|---|
| 7,127,069 | B2 | 10/2006 | Nguyen |
| 8,732,236 | B2 | 5/2014 | Altmaier et al. |
| 9,407,577 | B2 | 8/2016 | Hidaka |
| 2010/0227671 | A1 | 9/2010 | Laaroussi et al. |
| 2015/0348021 | A1 | 12/2015 | Rader et al. |
| 2018/0082516 | A1* | 3/2018 | Kubajak ..... G07F 17/3227 |

OTHER PUBLICATIONS

International Search Report and Written Opinion dated Dec. 10, 2019, PCT/US2019/052924, 11 pages.

* cited by examiner

*Primary Examiner* — Robert T Clarke, Jr.
(74) *Attorney, Agent, or Firm* — FisherBroyles, LLP; Rob L. Phillips

(57) ABSTRACT

A serial network switch for an electronic gaming machine adds auxiliary serial ports suitable for communication with an existing slot accounting system in a casino gaming environment.

7 Claims, 8 Drawing Sheets

APPARATUS FOR RETROFIT OF AUXILIARY SERIAL COMMUNICATION PORT(S) IN A SLOT ACCOUNTING SYSTEM

CROSS-REFERENCE TO RELATED APPLICATION(S)

This application is a nonprovisional of and claims the benefit under 35 U.S.C. 119(e) of U.S. Provisional Patent Application No. 62/742,058, filed Oct. 5, 2018, entitled "Apparatus for Retrofit of Auxiliary Serial Communication Port(s) in a Slot Accounting System," the contents of which are incorporated by reference as if fully disclosed herein.

TECHNICAL FIELD

Embodiments described herein relate to slot accounting systems that facilitate serial communication between host systems and electronic gaming machines in a casino environment and, in particular, to systems and methods for retrofitting auxiliary serial communication ports in existing slot accounting system network architectures.

BACKGROUND

A gaming industry entity, such as a casino, is typically required by a regulatory body to maintain accurate records of transactions initiated by or through each electronic gaming machine controlled by that entity. Conventionally, such records are communicated via a wired connection from an electronic gaming machine to a local or remote server. A network coupling the local or remote server and the electronic gaming machine (and/or other electronic gaming machines) is conventionally referred to as a "slot accounting system."

Conventional electronic gaming machines are typically manufactured with a discrete number of physical ports configured to communicably couple to a slot accounting system. In addition, once approved by a relevant regulatory body, an electronic gaming machine and/or software associated with an electronic gaming machine cannot generally be modified to incorporate new or additional features—including security-enhancing or functionality-enhancing features—without undergoing an expensive and time-consuming re-approval process conducted by, or under the authority of, the relevant regulatory body.

SUMMARY

Some embodiments described herein generally reference a peripheral device for an electronic gaming machine in a casino environment. The peripheral device, referred to herein as a "serial network switch," is configured to direct and route serial traffic between multiple serial communication ports. As a result of this construction, an electronic gaming machine incorporating a serial network switch can benefit from auxiliary, redundant, and/or additional serial ports, each of which can independently communicate with, and transact data with, an existing slot accounting system.

BRIEF DESCRIPTION OF THE DRAWINGS

Reference will now be made to representative embodiments illustrated in the accompanying figures. It should be understood that the following descriptions are not intended to limit this disclosure to one included embodiment. To the contrary, the disclosure provided herein is intended to cover alternatives, modifications, and equivalents as may be included within the spirit and scope of the described embodiments, and as defined by the appended claims.

The use of the same or similar reference numerals in different figures indicates similar, related, or identical items.

Figure 1:
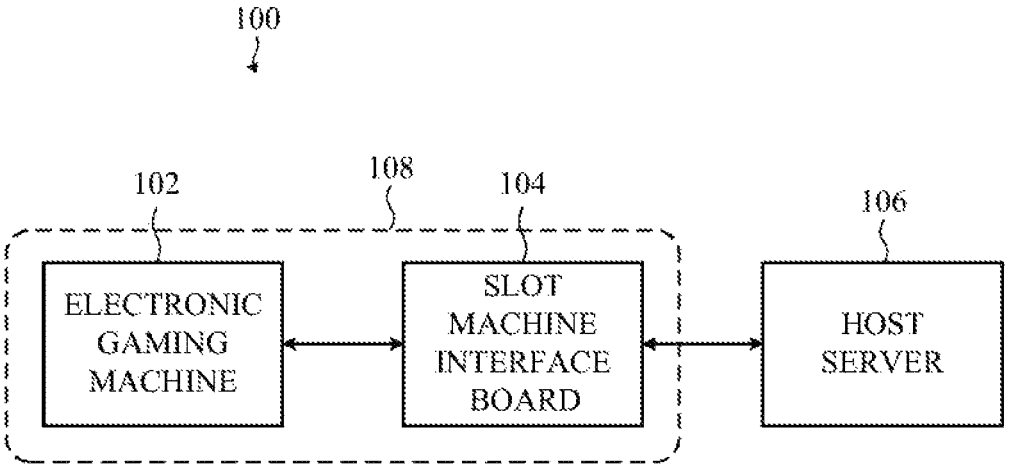
FIG. 1 is a schematic representation of a casino system configured for use in accordance with at least one embodiment such as described herein.

Additionally, it should be understood that the proportions and dimensions (either relative or absolute) of the various features and elements (and collections and groupings thereof) and the boundaries, separations, and positional relationships presented therebetween, are provided in the accompanying figures merely to facilitate an understanding of the various embodiments described herein and, accordingly, may not necessarily be presented or illustrated to scale, and are not intended to indicate any preference or requirement for an illustrated embodiment to the exclusion of embodiments described with reference thereto.

DETAILED DESCRIPTION

Embodiments described herein reference apparatuses and methods for retrofitting one or more auxiliary serial communication ports in an electronic gaming machine in communication with an existing slot accounting system of a casino gaming environment.

The phrase "slot accounting system," as used herein, is understood to refer to a serial communication network in a casino gaming environment that communicably couples a host server (also referred to as a "master controller") and one or more electronic gaming machines of a casino. Conventionally, a slot accounting system is used to maintain, for management and regulatory compliance, substantially real-time and accurate records of all activity (e.g., events, wagers, transactions) and meters (e.g., cash, credits, bill counts, and so on) of each electronic gaming machine under the control of a casino. The master controller and the electronic gaming machines are typically configured to bidirectionally transact data according to a standardized serial communication protocol, such as the Slot Accounting System protocol. In this manner, different electronic gaming machines manufactured by different entities can all interact with the same master controller (or multiple master controllers) in a single casino gaming environment.

As noted above, conventional electronic gaming machines are typically manufactured with a fixed number of serial ports, only one of which may be configured to communicably couple to a slot accounting system in order to perform accounting-related transactions. In addition, as noted above, once an electronic gaming machine is approved by a relevant regulatory body, the electronic gaming machine cannot generally be modified to incorporate new or additional features without undergoing an expensive and time-consuming re-approval process conducted by, or under the authority of, the relevant regulatory body. As a result, casino operators are not typically incentivized to upgrade or improve the functionality or security of already-approved electronic gaming machines.

As such, embodiments described herein reference apparatuses and methods for retrofitting one or more auxiliary serial communication ports in an electronic gaming machine without requiring modification of any hardware or components of the electronic gaming machine. As one example, as a result of the apparatuses and methods disclosed herein, an after-market device can be coupled to an auxiliary serial port and can interact with and/or otherwise observe data transacted with the slot accounting system (e.g., meter data, cash data, cashout data, voucher data, printer data, and so on).

More specifically, embodiments described herein reference a "serial network switch" (either unmanaged or managed, via software or otherwise) that includes a number of serial communication ports and a processor configured to direct serial data between the serial communication ports.

For example, a serial network switch, such as described herein, can be configured to direct serial data signals received at a first port of the serial network switch to a second port of the serial network switch via packet switching or any other suitable routing or data, packet, byte, or signal redirection or switching technique. In this manner, an electronic gaming machine that includes a single serial communication port can be supplemented with auxiliary serial communication ports, each of which can be functionally and communicably coupled to an existing slot accounting system via the serial network switch.

In some embodiments, a serial network switch, such as described herein, can include one or more processors configured to mirror or tap traffic directed between the various serial communication ports of the serial network switch to another electronic device or network (e.g., to a local or remote server via Wi-Fi or Ethernet networking protocols (facilitated by one or more networking devices or components, such as a network module) and associated communication circuitry and structure). For example, a serial network switch, such as described herein, may be communicably coupled to a player tracking server or promotion server. By monitoring transactions communicated from the electronic game machine to the slot accounting system, the serial network switch can provide useful player and/or meter information to the player tracking server and/or the promotion server without requiring either the player tracking server or the promotion server to be communicably coupled to, or otherwise able to interact with, the slot accounting system. As a result of this and other described and equivalent network architectures and constructions, a slot accounting system can be functionally isolated from other casino systems and networks, thereby increasing the security and integrity of the slot accounting system.

In some embodiments, a serial network switch, such as described herein, can include one or more processors configured to monitor traffic directed between the various serial communication ports of the serial network switch and, in response to specific events or data, communicate with another electronic device or network (e.g., a local or remote server via Wi-Fi or Ethernet networking protocols and associated communication circuitry and structure) via suitable hardware of the serial network switch. For example, in some embodiments, a serial network switch can include a Bluetooth module, a Wi-Fi module, or an Ethernet module (collectively referred to as a "network module") to communicate with other networks or devices. In one example, a serial network switch can intercept or otherwise mirror serial communications received from a casino accounting system or auxiliary device within a slot machine cabinet and can transmit those serial communications, and/or information derived therefrom, such as metadata, to a promotion server or player tracking system. In this manner, the promotion server or player tracking system may be informed in real time of transactions between a slot machine and a slot machine accounting system without requiring that the promotion server or player tracking system be directly communicably coupled to the slot machine accounting system.

In some embodiments, a serial network switch, such as described herein, can include one or more processors configured to initiate, modify, block, or supplement data or traffic directed to any of the various serial communication ports of the serial network switch. For example, a serial network switch may be configured to authenticate the identity of a device coupled to one of the serial communication ports (e.g., via public key encryption, challenge-response, certificates, and so on). In these examples, traffic between an authenticated device and the serial network switch can be encrypted. In other implementations of this example, the serial network switch may be configured to transmit a heartbeat signal, a periodic re-authentication challenge, and/or a periodic wake instruction to the authenticated device.

An auxiliary serial communication port, such as provided by a serial network switch such as described herein, can be used for any suitable purpose to communicably couple an electronic gaming machine, or a component thereof, to an existing slot accounting system. For example, with an auxiliary serial communication port, additional hardware (e.g., supplemental or redundant bill validators, coin hoppers, recyclers, ticket-in ticket-out systems, player tracking systems, systems to interface with a player's mobile or personal electronic device, and so on) can be added to an electronic game machine without modification to other hardware of that electronic gaming machine.

In another example, an auxiliary serial communication port, such as described herein, can be used to enable parallel communication between an electronic gaming machine and a master controller. More specifically, in this example, with multiple serial communication ports, different meters of an electronic gaming machine can be read substantially simultaneously.

For simplicity of description, the phrase "electronic gaming machine" as used herein is generally understood to refer to a stationary slot machine within a casino, however, it may be understood that this is merely one example of an electronic gaming machine. In other words, in some embodiments, other gaming industry entities and/or other stationary, portable, and/or digital (e.g., software-based) electronic gaming machines and/or services may be suitable for use with the various embodiments described herein and equivalents thereof.

In addition, as described herein, the phrase "processing unit" or, more generally, "processor" refers to a hardware-implemented data processing device or circuit physically structured to execute specific transformations of data including data operations represented as code and/or instructions included in a program that can be stored within and accessed from a memory. The term is meant to encompass a single processor or processing unit, multiple processors, multiple processing units, analog or digital circuits, or other suitably configured computing element or combination of elements.

These and other embodiments are discussed below with reference to FIGS. 1-6. However, those skilled in the art will readily appreciate that the detailed description given herein with respect to these figures is for explanatory purposes only and should not be construed as limiting.

For example, as noted above, a casino operator (herein, more broadly, a "gaming industry entity") typically provides numerous electronic devices on casino floors and elsewhere at which the operator is required to identify and authenticate players and track transactions arising between players and the various electronic devices on the casino floor. Examples of such electronic devices include electronic gaming machines, point-of-sale terminals, electronic table games, and so on.

More specifically, casino operators are commonly required to track transactions involving "cash" and its equivalents, where "cash" collectively herein refers to any form of financial consideration, such as currency bills issued by a governmental entity, bank credits, house credits, prepaid local or remote accounts, and any other form of transferable denominations of financial value and/or denominations that may be exchanged for denominations of financial value, whether inside the casino or elsewhere.

To facilitate the tracking and auditing of such transactions and the transfers of cash by and between players and casino operators, conventional casino operators often encourage players to utilize casino-issued "cards" that identify a player and, by extension, a player account held at a casino. In other cases, a casino operator may encourage players to use paper vouchers, typically referred to as "ticket in/ticket out" cards or paper vouchers/receipts.

To use a ticket in/ticket out card, a player, or, more generally, any individual in possession of the card, will fund an account associated with the ticket in/ticket out card by presenting cash to the casino or by debiting one or more real money accounts or charging one or more credit card or similar accounts. These debits and credits are exchanged for casino credits or cash value redeemable at the casino and other physical and digital properties.

Cash equivalent casino credit in a player account may be redeemed for practically any purpose in a casino environment, including wagering, bets using a casino game, purchasing meals or other goods, attending shows, or other activities. Credits may also be converted back into cash at the player's request. The exchange of cash for credits and vice versa may occur at booths, at electronic gaming machines, betting tables, on-line, via mobile device software applications, or otherwise. Regardless of how such transactions occur, regulatory bodies require a tracking of each credit/point at each instance in a transactions flow including from the instance at which a credit/point is generated (in exchange for cash), utilized (for example, wagering outcomes in an electronic gaming machine, or for an in-casino purchase), and/or reconverted into cash or some other form of consideration provided to the player.

Typically, tracking occurs across multiple casino computer systems and devices including, for example, master casino tracking systems, slot management systems, ticket in/ticket out management systems, point-of-sale systems, property management systems, such as those used for lodging, recreation and similar casino-related operations, individual electronic gaming machines, and otherwise.

Each of these and other devices are communicably coupled, via a communication network, to a central host server (or group of servers) that process and record each financial or cash equivalent transaction initiated or processed by a slot machine. Generally and broadly, as noted above, this system, or cooperation of multiple systems, is typically referred to as a "slot accounting system." In typical examples, the communication network is a serial communication network, but this may not be required of all embodiments; other embodiments can include other networks (redundant, failover, or otherwise) or network types.

It may be appreciated that a slot accounting system may be communicably coupled to practically any device or system involved in the granting, redeeming, transfer, or use of a point or a real money equivalent in a casino environment. As may be understood, these requirements impose a high layer of complexity on casino games, systems, and operators.

Further, as noted above, the underlying game-play of casino gaming machines and systems are tightly regulated by one or more regulatory bodies that may vary from jurisdiction to jurisdiction. As noted above, any change to certain hardware and/or software components of an electronic gaming machine often requires re-verification and re-approval by gaming regulators. The re-certification process can be lengthy and expensive and, during the process, an electronic gaming machine is taken offline and is unavailable to players. Similarly, any equipment or system communicably coupled to a regulated system must typically itself be regulated or otherwise approved. For example, a point of sale system in a casino gift shop or restaurant is not typically communicably coupled to a slot accounting system because doing so typically requires the point of sale system to be regulated and/or otherwise approved of by a regulatory body.

These regulatory and technical constraints often discourage casino operators from changing the underlying game-play functionality or otherwise modifying casino games, including the game machine processing unit(s) that facilitate gameplay, manage betting, and/or maintain meters in an electronic gaming machine. Instead, new functionality and hardware are typically designed in such a manner as to be isolated and/or insulated from any regulated hardware or software components, and, ideally, to not require interaction with such components at all.

Additionally, as may be appreciated, electronic gaming machines may be in operation for decades. It is therefore often desirable for new features and functionality to be easily retrofitted to older electronic gaming machines, some of which may not have been designed with modern technological capabilities in mind.

One conventional approach for addressing some of the above-referenced regulatory challenges has involved the optional use of a dedicated processor/processing unit for managing communications between an electronic gaming machine and a slot accounting system server. This dedicated processing unit is commonly known as a "slot machine interface board" or a "SMIB."

A slot machine interface board enables an electronic gaming machine and/or a host server of a slot accounting system to communicate with one or more peripheral devices without the involvement of or interaction with a game machine processing unit. These peripheral devices typically do not affect underlying game-play of an electronic gaming machine (which is controlled by a "game machine processing unit") but do provide additional incentives and features to players. For example, rewarding of coupons, notifying players of promotions, or otherwise are often provided by peripheral devices interconnected to one or more electronic gaming machines by one or more slot machine interface boards.

A slot machine interface board also may enable an electronic gaming machine to communicate with other casino system servers and external servers over one or more networks, again without involving the game machine processing unit. In further examples, other designs are considered, some of which virtualize the function of a slot machine interface board within another electronic gaming machine processor. Depending on a particular implementation, different approaches may be required to incorporate new functionality without requiring re-certification of the game machine processing unit.

However, a conventional slot machine interface board typically includes only a single serial connection to communicably couple to a slot accounting system. For example, FIG. 1 depicts a simplified system diagram of a conventional slot accounting system 100 that may be implemented by a casino. The conventional slot accounting system 100 includes an electronic gaming machine 102 that is communicatively coupled to a slot machine interface board 104 that, in turn, is communicably coupled to a host server 106 via a single serial communication interface. The serial communication interface between the slot machine interface board 104 and the host server 106 facilitates rapid and secure communication of information and data from the electronic gaming machine 102 to the host server 106. As noted above, such information can include transaction data, event data, meter data, and so on. In the illustrated embodiment, the slot machine interface board 104 is disposed, along with the electronic gaming machine 102, within a game machine cabinet 108.

As a result of this construction, however, additional features and functions cannot easily be added to the electronic gaming machine 102 without replacing the slot machine interface board 104 or one or more other components within the game machine cabinet 104. Accordingly, to account for these and other shortcomings of conventional solutions, embodiments described herein reference a serial network switch that can be coupled between the slot machine interface board 104 and the host server 106. As described above, a serial network switch, such as described herein, effectively divides the single serial port of the slot machine interface board 104 into two or more serial ports, each of which can communicate with the host server 106.

Figure 2:
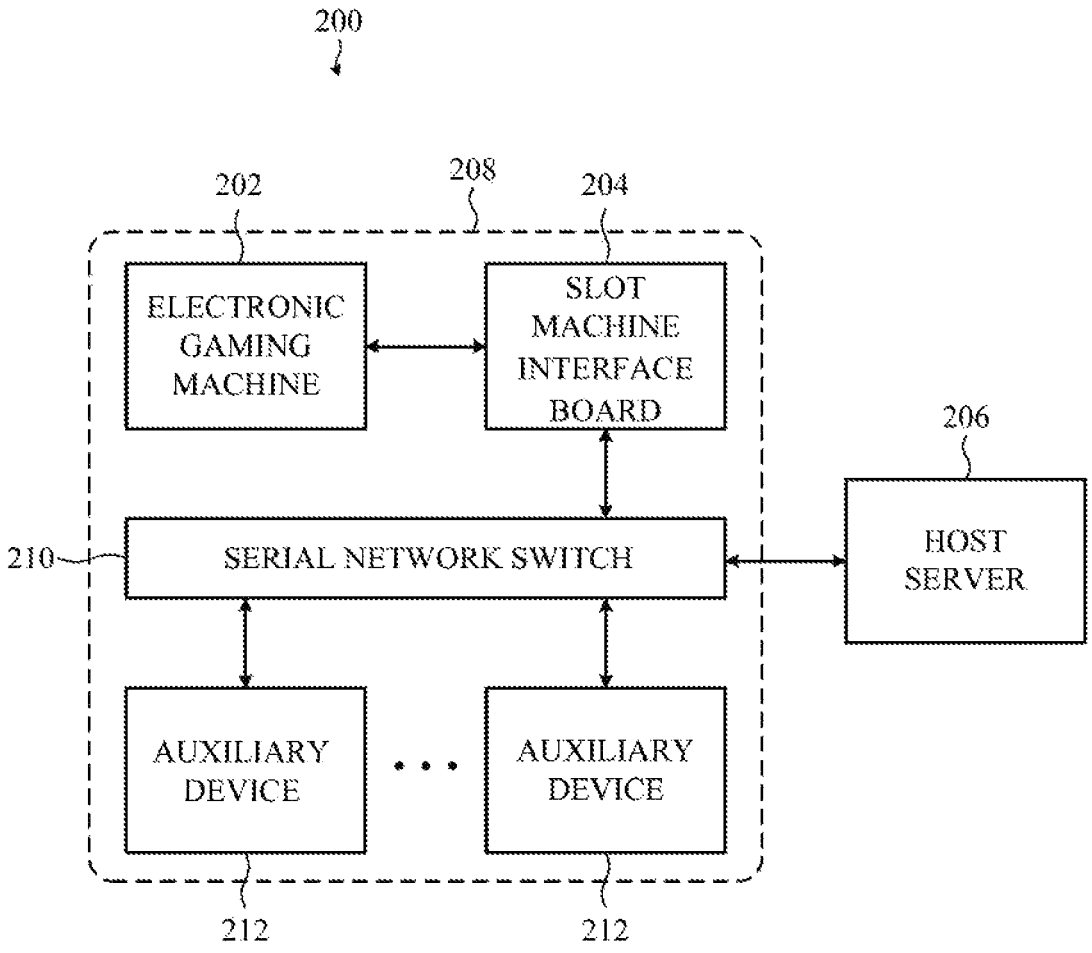
FIG. 2 is a simplified schematic representation of a casino system, such as described herein, in which a peripheral device, identified as an authenticating serial network switch, is configured to communicate with a host server within a casino network.

FIG. 2 is a simplified schematic representation of a slot accounting system 200 similar to the system described in reference to FIG. 1. More particularly, the slot accounting system 200 includes an electronic gaming machine 202 that is communicably coupled to a slot machine interface board 204 that is configured to communicate with a host server 206 in order to convey meter information and other data from the electronic gaming machine 202 to the host server 206. As with the embodiment depicted in FIG. 1, the electronic gaming machine 202 and the slot machine interface board 204 are disposed within a game machine cabinet 208.

The depicted embodiment further includes a serial network switch 210. As described above, the serial network switch 210 can be configured to communicably couple one or more auxiliary devices 212 to the host server 206. Additionally, as shown, the serial network switch 210 couples the slot machine interface board 204 to the host server 206.

As a result of this construction, the serial network switch 210 provides the game machine cabinet 208 with auxiliary serial ports (two are illustrated), each of which can communicate to the host server 206. As described above, the auxiliary serial ports can be used for any suitable purpose.

Figure 3A:
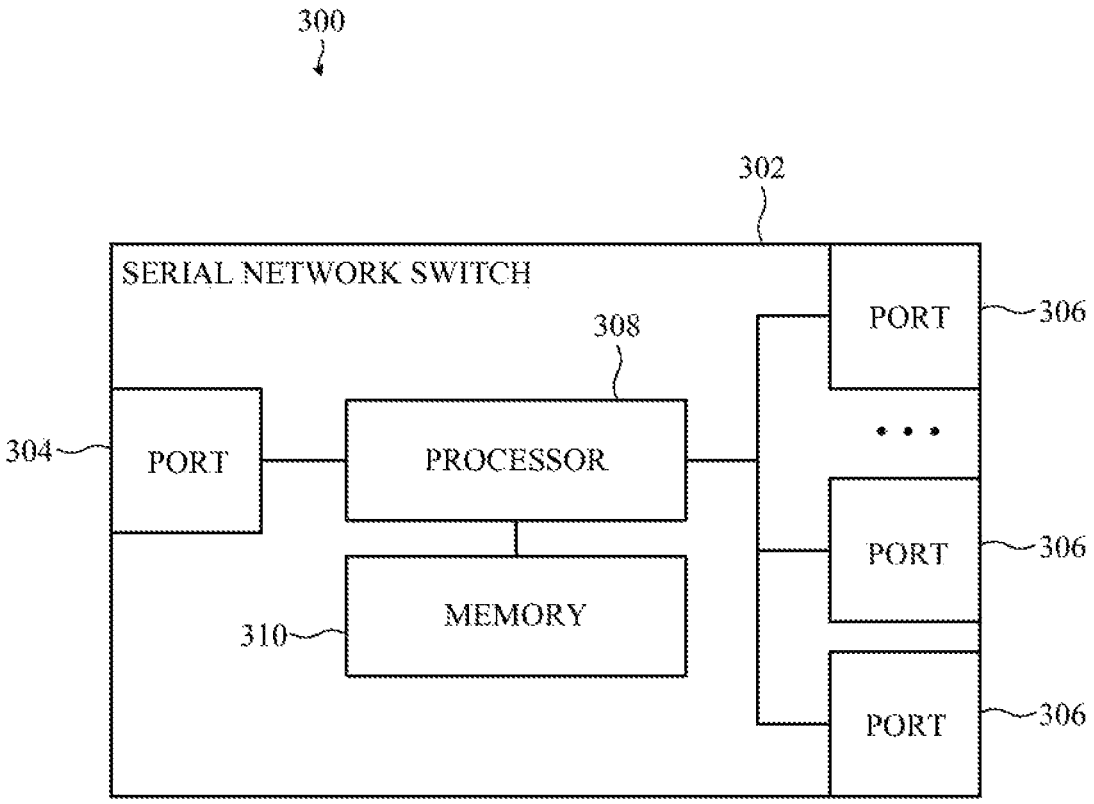
FIG. 3A is a simplified schematic representation of an authenticating serial network switch, such as described herein.

A serial network switch can be manufactured and/or otherwise implemented in a number of suitable ways. For example, FIG. 3A is a simplified schematic representation of a serial network switch 300, such as described herein. The serial network switch 300 can be optionally disposed within a housing 302 (see, e.g., FIG. 3B), although this may not be required of all embodiments.

The serial network switch 300 includes a primary serial port 304 that may be configured to couple to a slot accounting system or a host system of a slot accounting system such as described herein. In other embodiments, more than one primary serial port can be included; the depicted construction is merely one example.

The serial network switch 300 also includes a set of auxiliary serial ports 306, three of which are shown in the figure. The set of auxiliary serial ports 306 and the primary serial port 304 are communicably coupled a processor 308. The serial network switch 300 further includes a memory 310.

In the illustrated embodiment, the processor 308 of the serial network switch 300 can be configured to monitor serial signals and/or data received by the primary serial port 304 for header and/or address information. Once a header or address is received and/or otherwise recognized by the processor 308 of the serial network switch 300, the processor 308 can cause the serial signals and/or data received by the primary serial port 304 to be from a selected one of the set of auxiliary serial ports 306. In other words, each auxiliary serial port 306 may be associated with, or otherwise coupled to, a particular device associated with a particular address. In some cases, the associations between a particular address and a particular auxiliary serial port may be stored in a lookup table or other memory or database structure in the memory 310. A person of skill in the art may appreciate that any number of suitable routing and/or data redirection techniques may be employed in and/or otherwise used by the serial network switch 300 to facilitate serial communication by and between the primary serial port(s) and the auxiliary serial ports(s).

In some cases, the processor 308 of the serial network switch 300 can be configured to monitor or otherwise tap data transacted between the primary serial port(s) and/or the auxiliary serial port(s). The processor 308 can monitor the transacted data for any suitable purpose including, but not limited to: verifying the identity of devices coupled to the serial port(s); maintaining a redundant or backup database of data transmitted to a host system; malware and/or intrusion detection; and so on.

As noted above with respect to other embodiments described herein, the processor 308 of the serial network switch 300 can be further configured to facilitate secure or otherwise encrypted communications across one or more of the primary serial port(s) or the auxiliary serial port(s). More specifically, in some embodiments, the serial network switch 300 can implement port-specific, hardware encryption or other authentication. As may be appreciated, any suitable encryption or authentication technique can be used.

In still further embodiments, the serial network switch 300—and more specifically, the processor 308 of the serial network switch 300—can be configured to periodically ping one or more devices coupled to one or more of the port(s) in order to verify that the device is still able to communicate.

For example, certain serial communication protocols may require a periodic heartbeat or ping signal to be received for a port to remain open to receiving data; if a port of a device, such as an electronic gaming machine, does not receive a heartbeat signal within a particular timeout period, the device may determine that a fault condition has occurred.

In still further embodiments, the serial network switch 300—and more specifically, the processor 308 of the serial network switch 300—can be configured to receive a ping from one or more devices coupled to one or more of the port(s) in order to verify that the device is still able to communicate. If the periodic heartbeat or ping signal is not received by the serial network switch 300 at a specific port within a particular timeout period, the serial network switch 300 may determine that a fault condition has occurred. Thereafter, the serial network switch 300 can close the respective port to prevent future communication therefrom or thereto.

Figure 3B:
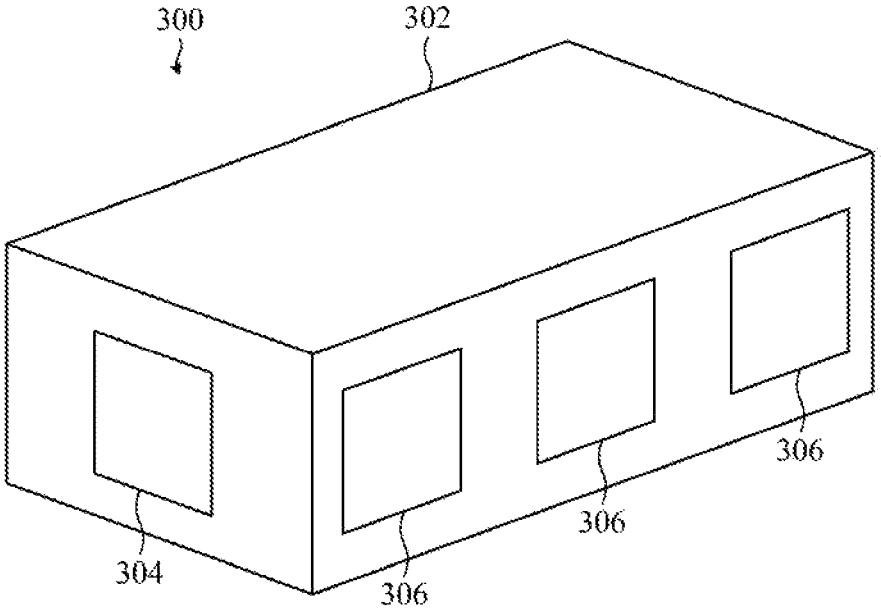
FIG. 3B depicts an example authenticating serial network switch, such as described herein.

The foregoing embodiments depicted in FIGS. 2-3B and the various alternatives thereof and variations thereto are presented, generally, for purposes of explanation, and to facilitate an understanding of various configurations and constructions of a serial network switch that can be incorporated in, and/or otherwise coupled to, an electronic gaming machine, such as described herein. However, it will be apparent to one skilled in the art that some of the specific details presented herein may not be required in order to practice a particular described embodiment, or an equivalent thereof.

Thus, it is understood that the foregoing and following descriptions of specific embodiments are presented for the limited purposes of illustration and description. These descriptions are not targeted to be exhaustive or to limit the disclosure to the precise forms recited herein. To the contrary, it will be apparent to one of ordinary skill in the art that many modifications and variations are possible in view of the above teachings.

Figure 4:
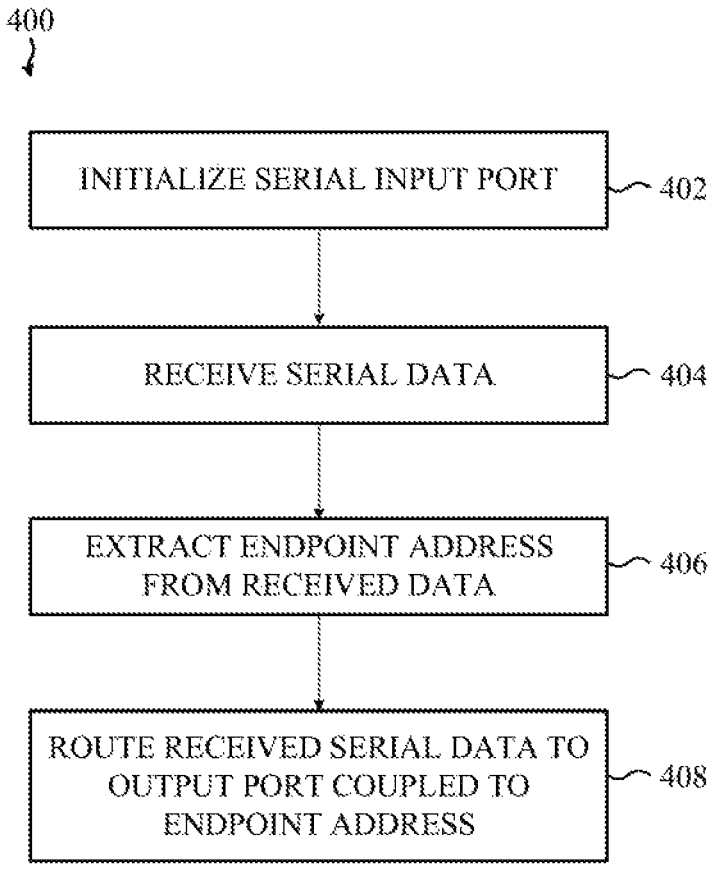
FIG. 4 is a flow chart that depicts example operations of a method of redirecting and/or routing serial signals received from a slot accounting system, such as described herein.
Figure 5:
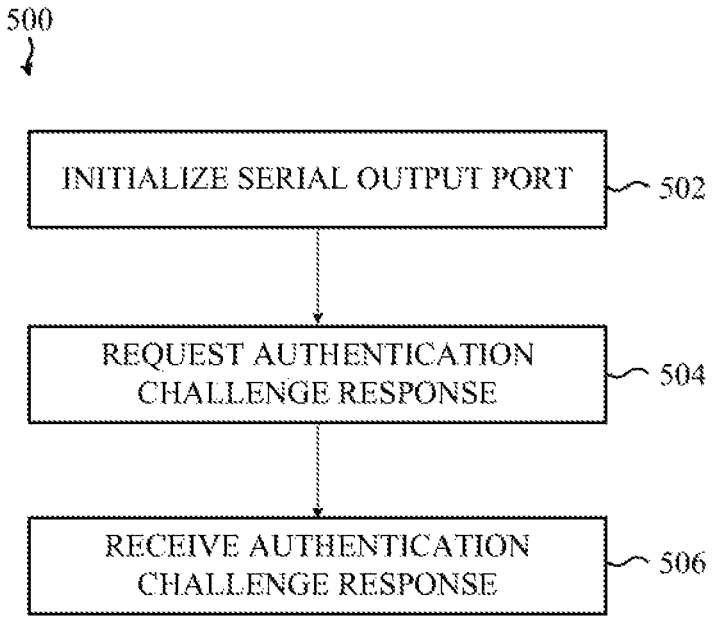
FIG. 5 is a flow chart that depicts example operations of a method of authenticating a serial port of a slot accounting system, such as described herein.
Figure 6:
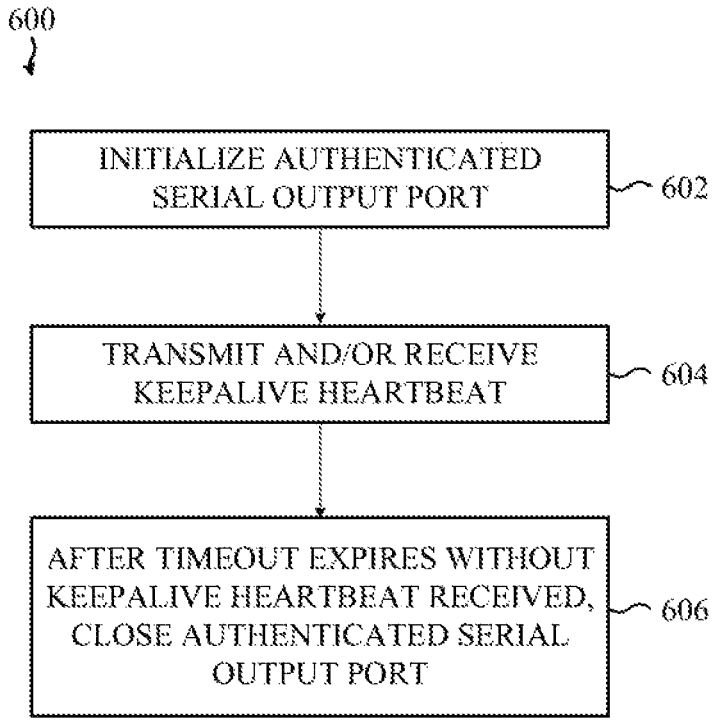
FIG. 6 is a flow chart that depicts example operations of a method of maintaining authentication of a serial port of a slot accounting system, such as described herein.

Generally and broadly FIGS. 4-6 are flow charts depicting example methods of operating a serial network switch to receive and/or redirect serial signals in a slot accounting system, such as described herein.

FIG. 4 is a flow chart that depicts example operations of a method of redirecting and/or routing serial signals received from a slot accounting system, such as described herein. The method 400 can be performed in whole or in part by a processor of a serial network switch, such as described herein, such as the processor 308 described in reference to FIGS. 3A-3B.

The method 400 begins at operation 402 in which a serial input port is initialized. Thereafter, at operation 404, serial data may be received at the initialized serial input port. Next, at operation 406, header data or other address data can be extracted and/or analyzed to determine an intended recipient device of the received data. Finally, at operation 408, the received serial data is routed to a selected serial port that corresponds to, or is otherwise logically linked to, a device associated with the extracted header data and/or other address data.

FIG. 5 is a flow chart that depicts example operations of a method of authenticating a serial port of a slot accounting system, such as described herein. As with the method 400 depicted in FIG. 4, the method 500 can be performed in whole or in part by a processor of a serial network switch, such as described herein, such as the processor 308 described in reference to FIGS. 3A-3B.

The method 500 begins at operation 502 in which a serial port is initialized. Thereafter, at operation 504, an authentication challenge is administered to a device coupled to the initialized port. Finally, at operation 506, an authentication challenge response is received from the device coupled to the initialized port.

FIG. 6 is a flow chart that depicts example operations of a method of maintaining authentication of a serial port of a slot accounting system, such as described herein. As with the method 400 depicted in FIG. 4, the method 600 can be performed in whole or in part by a processor of a serial network switch, such as described herein, such as the processor 308 described in reference to FIGS. 3A-3B.

The method 600 begins at operation 602 in which a serial port is initialized. Thereafter, at operation 604, a heartbeat signal is either or both transmitted by or received at the serial port. Finally, at operation 606, an authenticated serial port is closed if the heartbeat signal at operation 604 is not received before a selected timeout expires.

Figure 7:
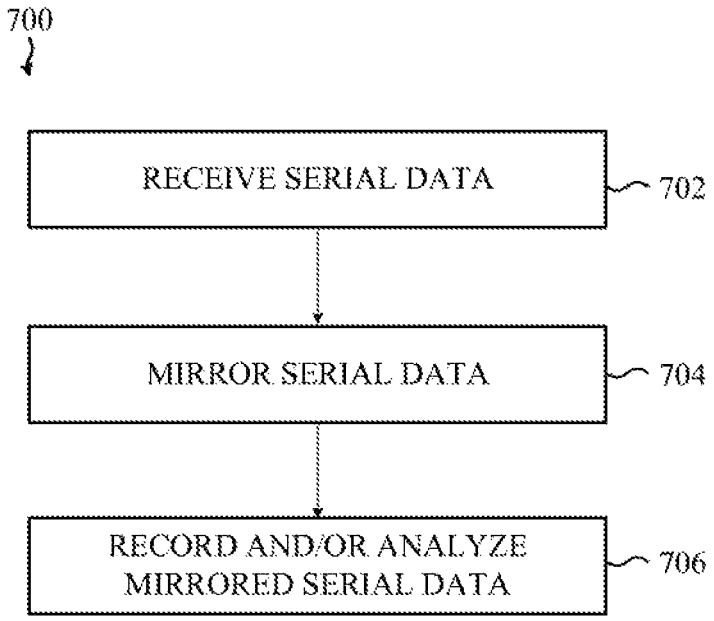
FIG. 7 is a flow chart that depicts example operations of a method of monitoring a serial port of a slot accounting system, such as described herein.

FIG. 7 is a flow chart that depicts example operations of a method of monitoring a serial port of a slot accounting system, such as described herein. As with the method 400 depicted in FIG. 4, the method 700 can be performed in whole or in part by a processor of a serial network switch, such as described herein, such as the processor 308 described in reference to FIGS. 3A-3B.

The method 700 includes operation 702 in which serial data is received at a port of a serial network switch, such as described herein. Thereafter, at operation 704, the serial data received is mirrored and/or duplicated. For example, the serial data can be mirrored into a buffer or shift register or other physical or software-facilitated memory structure. Finally, at operation 706, the mirrored serial data can be saved, recorded, and/or otherwise analyzed such as described herein.

One may appreciate that, although many embodiments are disclosed above, the operations and steps presented with respect to methods and techniques described herein are meant as exemplary and accordingly are not exhaustive. One may further appreciate that alternate step order or fewer or additional operations may be required or desired for particular embodiments.

Although the disclosure above is described in terms of various exemplary embodiments and implementations, it should be understood that the various features, aspects, and functionality described in one or more of the individual embodiments are not limited in their applicability to the particular embodiment with which they are described, but instead can be applied, alone or in various combinations, to one or more of the some embodiments of the invention, whether or not such embodiments are described and whether or not such features are presented as being a part of a described embodiment. Thus, the breadth and scope of the present invention should not be limited by any of the above-described exemplary embodiments but is instead defined by the claims herein presented.

For example, as a result of the foregoing described embodiments, a device or service or system that is not required to be regulated by a regulatory body can interact with a system, such as a slot accounting system, that is required to be regulated by a regulatory body. As a result of the apparatuses and systems described herein, therefore, additional services and functions can be added to an existing slot machine or casino floor. Example services include, but may not be limited to: integrating a promotion system with a slot accounting system; integrating a casino rewards system with a slot accounting system; integrating slot machine play with other casino games or systems; and so on.

In addition, it is understood that organizations and/or entities responsible for the access, aggregation, validation, analysis, disclosure, transfer, storage, or other use of private data such as described herein, including private financial data, will preferably comply with published and industry-established privacy, data, and network security policies and practices. For example, it is understood that data and/or information obtained from remote or local data sources, only on informed consent of the subject of that data and/or information, should be accessed and/or aggregated only for legitimate, agreed-upon, and reasonable uses.

What is claimed is:

1. A serial network switch for rerouting serial communications from a slot accounting system directed to a slot machine interface board ("SMIB") within a cabinet of a slot machine, the serial network switch comprising:

an input port for communicably coupling to, and receiving serial communications from, the slot accounting system;

a SMIB port for communicably coupling to the SMIB;

a processor coupled to the input port and the SMIB port; and a network module coupled to the processor and communicably coupled to a server; wherein:

the processor is configured to transmit at least one serial communication received from the slot accounting system via the input port to the server via the network module.

2. The serial network switch of claim 1, wherein the network module comprises one of a Wi-Fi module or an Ethernet module.

3. The serial network switch of claim 1, wherein the server is one of a promotion server or a player tracking server.

4. The serial network switch of claim 1, further comprising:

an auxiliary port for communicably coupling to a bill validator within the cabinet; wherein the processor is configured to route serial communications received via the input port from the slot accounting system to one of the SMIB or the bill validator based on data extracted by the processor from the received serial communications.

5. The serial network switch of claim 4, wherein the data extracted from the received serial communications comprises an endpoint address.

6. The serial network switch of claim 1, wherein the processor is configured to authenticate communications from the slot accounting system.

7. The serial network switch of claim 1, wherein the received serial communications are formatted according to the Slot Accounting System protocol.

* * * * *